US005451047A

United States Patent [19]

Liu

[11] Patent Number: 5,451,047

[45] Date of Patent: Sep. 19, 1995

[54] SOUND-PRODUCING APPARATUS

[76] Inventor: Chao-Jih Liu, No.166, Kung-Yeh Rd., Lung-Ching Hsiang, Taichung Hsien, Taiwan

[21] Appl. No.: 369,671

[22] Filed: Jan. 6, 1995

[51] Int. Cl.[6] ..... A63B 59/06

[52] U.S. Cl. ..... 273/72 R; 273/26 B

[58] Field of Search ..... 446/418, 419, 421, 422; 273/26 B, 72 R, 72 A, 186.2

[56] References Cited

U.S. PATENT DOCUMENTS

| | | | |
|---|---|---|---|
| 1,325,813 | 12/1919 | Taylor, Jr. | 273/72 R |
| 3,137,504 | 6/1964 | Zordan et al. | 273/26 B |
| 4,898,386 | 2/1990 | Anderson | 273/26 B |
| 5,133,551 | 7/1992 | Handy et al. | 273/72 R |

*Primary Examiner*—Mickey Yu

*Attorney, Agent, or Firm*—Knobbe, Martens, Olson & Bear

[57] ABSTRACT

A sound-producing apparatus includes an elongated hollow bat-like member having a striking section, a handle section, and an intermediate section interconnecting the striking section and the handle section. A closure member is formed integrally at the upper end of the striking section. The intermediate section has a plurality of pleats. A plug member is fixed to the lower end of the handle section. A rod member is received in the handle section and connected to the plug member in order to prevent a rigid ball from entering the handle section.

2 Claims, 2 Drawing Sheets

SOUND-PRODUCING APPARATUS

BACKGROUND OF THE INVENTION

1. Field of the Invention

This invention relates to a sound-producing apparatus, more particularly to a bat-like sound-producing apparatus which is safe and is able to provide an improved amusing effect.

2. Description of the Related Art

FIG. 1 shows a conventional sound-producing apparatus which includes a striking section 10, a handle section 20, and an intermediate section 30. The conventional sound-producing apparatus is in the form of an elongated hollow bat-like member and is made of a plastic material. A foam member 11 sleeves around the striking section 10. The striking section 10 has a first open end which is connected to the intermediate section 30, and a second open end which is closed by a plug member 13. A least one rigid ball 40 may be disposed in the conventional sound-producing apparatus through the second open end of the striking section 10 before the plug member 13 is adhered to the second end of the striking section 10 by means of an adhesive to close said second end. A second foam member 21 sleeves around the handle section 20. The handle section 20 has a closed first end and a open second end which is connected to the intermediate section 30.

In use, the user can wield the conventional sound-producing apparatus in order to allow the ball 40 received therein to hit the plug member 13 and produce sound. This provides amusing and interesting effects to the user. However, because the plug member 13 is often struck by the ball 40, and is adhered to the second end of the striking section 10 by an adhesive, the plug member 13 is liable to disengage from the striking section 10 after the conventional sound-producing apparatus is used for a period of time. If the plug member 13 is detached from the striking section 10 when the user wields the apparatus, the ball 40 will fly out of the apparatus and people may be injured by the ball 40. In addition, because the inner diameter of the handle section 20 has to be small, in order to permit the user to hold it and yet maintain a given structural strength, the ball 40 sometimes becomes stuck in the handle section 20, making the apparatus inoperative.

Furthermore, the ball 40 slides or rolls over the internal face of the conventional sound-producing apparatus and produces a relatively small sound, which does not enhance the amusing and interesting effects of the conventional sound-producing apparatus.

SUMMARY OF THE INVENTION

It is an object of this invention to provide a sound-producing apparatus which can prevent the ball from escaping from the striking section of the sound-producing apparatus.

It is another object of this invention to provide a sound-producing apparatus which can prevent the ball from becoming stuck in the handle section of the sound-producing apparatus.

It is yet another object of this invention to provide a sound-producing apparatus which can enhance the amusing and interesting effects.

Accordingly, the sound-producing apparatus of this invention comprises:

an elongated hollow bat-like member having a striking section with first and second ends, a handle section with first and second ends, and an intermediate section interconnecting the second end of the striking section and the first end of the handle section, the second end of the striking section having a closure member integrally formed therein, the intermediate section having a plurality of pleats and an inside diameter which is increased gradually from the second end of the handle section to the first end of the striking section;

a plug member fixed to the first end of the handle section of the sound-producing apparatus;

a rod member received in the handle section of the sound-producing apparatus, the rod member having a first end connected to the plug member and a second end extending to the second end of the handle section of the sound-producing apparatus, so that an annular space of predetermined width is formed between the rod member and the handle section of the sound-producing apparatus; and at least one rigid ball received in the sound-producing apparatus, the rigid ball having a diameter greater than the predetermined width of the annular space so that the rigid ball will not enter the handle section of the sound-producing apparatus.

Since the second end of the striking section is provided with an integrally formed closure member, the ball will not escape from the striking section even though the closure member is usually hit by the ball. The rod member can prevent the ball from entering the handle section and becoming stuck in the same. In addition, with the pleats of the intermediate section, the ball can produce an amusing sound when it slides and/or rolls over the intermediate section while the sound-producing apparatus is wielded.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
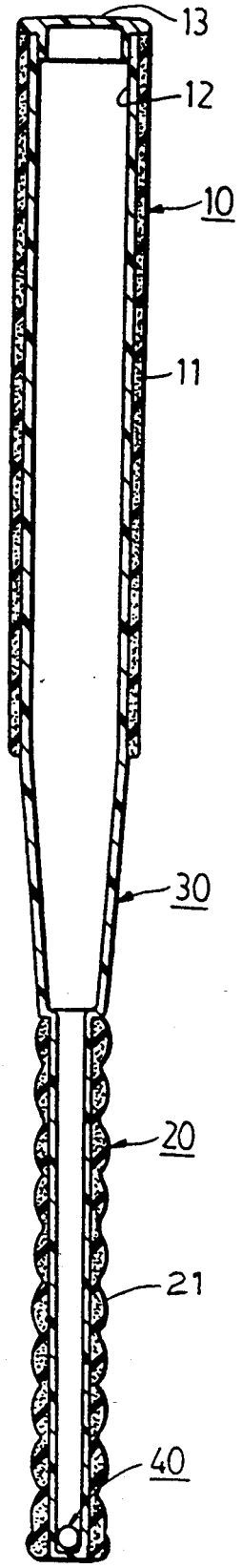
FIG.1 PRIOR ART
FIG. 1 is a sectional view of a conventional sound-producing apparatus.
Figure 2:
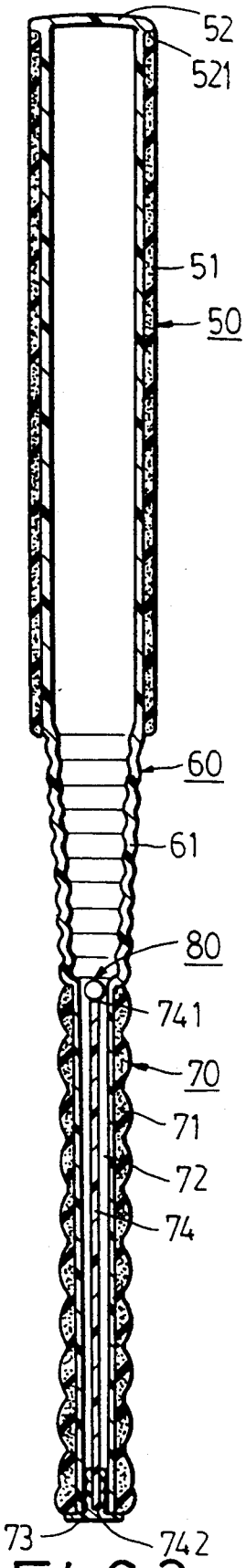
FIG. 2 is a sectional view of a preferred embodiment of a sound-producing apparatus of this invention.

FIG. 2 is shown to comprise a preferred embodiment of a sound-producing apparatus of this invention. The sound-producing apparatus is in the form of an elongated hollow bat-like member which includes a striking section 50, a handle section 70, and an intermediate section 60 interconnecting the striking section 50 and the handle section 70.

The striking section 50 of the sound-producing apparatus has a foam member 51 that sleeves around the striking section 50. A closure member 52 is integrally formed with the second or upper end of the striking section 50. The closure member 52 has a flange 521 extending radially therefrom in order to prevent the foam member 51 from disengaging from the upper end of the striking section 50 of the sound-producing apparatus.

The intermediate section 60 is connected to the first or lower end of the striking section 50 and to the second or upper end of the handle section 70. A steel ball 80 is received in the sound-producing apparatus. However, more than one steel ball 80 may be received in the sound-producing apparatus. The intermediate section 60 has a plurality of pleats 61. The inside diameter of the intermediate section 60 is increased gradually from the second or upper end of the handle section 70 to the lower end of the striking section 50. This configuration of the intermediate section 60 can facilitate the ball 80 to slide or roll from the intermediate section 60 to the striking section 50. A fluorescent sticker may be adhered to the intermediate section 60 or a fluorescent material may be added to the! plastic material which is used to make the sound-producing apparatus in order to enhance the attractiveness of the apparatus at night or a dark place.

The handle section 70 also has a foam member 71 sleeving therearound. The lower end of the handle section 70 is an open end and the ball 80 can be disposed into the sound-producing apparatus through the lower end of the handle section 70. A plug member 73 is affixed to, and thereby closes, the lower end of the handle section 70 of the sound-producing apparatus by means of an adhesive. The plug member 73 is T-shaped in cross section. A rod member 74 is received in the handle section 70 of the sound-producing apparatus. The rod member 74 has a first end 742 connected to the plug member 73 and a second end 741 extending to the second end of the handle section 70 of the sound-producing apparatus, so that an annular space 72 with a predetermined width is formed between the rod member 74 and the handle section 70. It is noted that the steel ball 80 has a diameter greater than the predetermined width of the annular space 72 so that the steel ball 80 will not enter and become stuck in the handle section 70.

Since the upper end of the striking section 50 is provided with the integrally formed closure member 52, the ball 80 will not escape from the striking section 50 even if the closure member 52 is usually hit by the ball 80. Therefore, this sound-producing apparatus is more safe than that of the prior art. In addition, the rod member 74 can prevent the ball 80 from entering the handle section 70 and becoming stuck in the same. Also, with the pleats 61 of the intermediate section 60, the ball 80 can produce an amusing sound when it slides or rolls over the pleats 61 of the intermediate section 60 while the sound-producing apparatus is wielded. This can enhance the amusing and interesting effects of the sound-producing apparatus.

With this invention thus explained, it is apparent that numerous modifications and variations can be made without departing from the scope and spirit of this invention. It is therefore intended that this invention be limited only as indicated in the appended claims.

I claim:

1. A sound-producing apparatus comprising:

an elongated hollow bat-like member having a striking section with first and second ends, a handle section with first and second ends, and an intermediate section interconnecting said first end of said striking section and said second end of said handle section, said second end of said striking section having a closure member integrally formed therewith, said intermediate section having a plurality of pleats and an inside diameter which is increased gradually from said second end of said handle section to said first end of said striking section;

a plug member fixed to said first end of said handle section of said sound-producing apparatus;

a rod member received in said handle section of said sound-producing apparatus, said rod member having a first end connected to said plug member and a second end extending to said second end of said handle section of said sound-producing apparatus, so that an annular space with a predetermined width is formed between said rod member and said handle section of said sound-producing apparatus; and at least one rigid ball received in said sound-producing apparatus, said rigid ball having a diameter greater than said predetermined width of said annular space so that said rigid ball will not enter said handle section of said sound-producing apparatus.

2. A sound-producing apparatus as claimed in claim 1, wherein said striking section of said sound-producing apparatus has a foam member that sleeves around said striking section, and wherein said closure member has a flange extending radially therefrom in order to prevent said foam member from disengaging from said second end of said striking section of said sound-producing apparatus.

* * * * *